US007258252B2

(12) United States Patent
Waters

(10) Patent No.: US 7,258,252 B2
(45) Date of Patent: Aug. 21, 2007

(54) LIQUID DISPENSING SYSTEMS AND APPARATUS

(76) Inventor: Marshall Waters, 292 Church Street, Richmond, Victoria, 3121 (AU)

( * ) Notice: Subject to any disclaimer, the term of this patent is extended or adjusted under 35 U.S.C. 154(b) by 93 days.

(21) Appl. No.: 10/778,876

(22) Filed: Feb. 13, 2004

(65) Prior Publication Data

US 2005/0103804 A1 May 19, 2005

Related U.S. Application Data

(63) Continuation of application No. PCT/AU02/01097, filed on Aug. 15, 2001.

(30) Foreign Application Priority Data

Aug. 15, 2001 (AU) ..... 7039
Aug. 15, 2001 (AU) ..... 7040
Aug. 15, 2001 (AU) ..... 201100273
Aug. 15, 2001 (AU) ..... 201100274

(51) Int. Cl.
*B67D 1/08* (2006.01)

(52) U.S. Cl. ..... 222/152; 222/190; 222/185.1

(58) Field of Classification Search ..... 222/129, 222/144, 146.1, 185.1, 152, 190
See application file for complete search history.

(56) References Cited

U.S. PATENT DOCUMENTS 1,749,194 A * 3/1930 Schmitt ..... 62/339
2,045,440 A * 6/1936 Cole ..... 62/339
2,359,790 A * 10/1944 Rinehart et al. ..... 62/395
3,880,330 A 4/1975 Leas et al.
4,932,561 A 6/1990 Boxall
5,890,629 A * 4/1999 Loew ..... 222/144.5
6,085,540 A * 7/2000 Davis ..... 62/389
6,190,549 B1 * 2/2001 Schwartz et al. ..... 210/198.1

FOREIGN PATENT DOCUMENTS

EP 336730 B1 12/1993
WO WO87/02345 A 4/1987
WO WO 00/06451 A 2/2000

* cited by examiner

*Primary Examiner*—Philippe Derakshani
(74) *Attorney, Agent, or Firm*—The Halvorson Law Firm

(57) ABSTRACT

A dispensing means with a viewability of the container from which a liquid such as wine, olive oil or fresh juice is being dispensed and maintaining the liquid free from deterioration or contamination by use of inert gas relative to the liquid. A base unit (4) including an internal reservoir (8) to hold liquids has a top opening (22) that feeds to the reservoir (8) and able to receive the neck (12*c*) and outlet (12*b*) of an inverted replaceable bottle (12). A sealing means retains the bottle (12) in position. A dispensing outlet pipe (15) leads from the bottom of the reservoir (8) through an insulation case (7) to an external tap (15*b*). A gas input (14) leads through a top annular part (13*a*) on an inner container to the top of the reservoir (8) for supplying an inert gas such as nitrogen, nitrous oxide or argon to the liquid food product.

22 Claims, 3 Drawing Sheets

LIQUID DISPENSING SYSTEMS AND APPARATUS

This application is a continuation of pending PCT application PCT/AU02/01097, which claims priority based upon Australian Provisional Application Serial Nos. PR 7040 dated Aug. 15, 2001, PR 7039 dated Aug. 15, 2001, 2001100273 dated Aug. 15, 2001; and 2001100274 dated Aug. 15, 2001.

TECHNICAL FIELD

This invention relates to a system and a liquid dispensing device for dispensing a liquid food product including wine, olive oil or fresh juice such as orange juice. In particular it comprises a unique method for the transportation, supply, storage, preservation, temperature control and dispensing of wine although it is not limited to such and the system is applicable to other perishable liquids including olive oil and fruit juices.

BACKGROUND ART

To date businesses such as restaurants, cafes, pubs and hotels, which are in the business of providing to customers wine by the glass ("wine resellers"), traditionally use 750 ml bottles or buy wine in bag in a boxes known in Australia as "cask wine". Wine resellers need to purchase large quantities of wine in 750 ml bottles. These are transported in boxes of 12 to the wine retailer's premises where they are stored. Therefore, a lot of the transport cost and weight is in the packaging. Each 750 ml bottle contains five "standard glasses" of wine. In businesses where wine is sold by the glass, each bottle must be opened, poured, corked and recorked manually each time a glass of wine is dispensed.

Once emptied the bottles are not reused because it is uneconomic to return each bottle rewash and refill and recork for such a small container.

Therefore, there are a number of disadvantages associated with the single 750 ml bottle method of wine supply, storage and dispensing ("the single bottle system"): 1. Because of oxidation, once a bottle of wine is opened the quality of the wine remaining in the open bottle decreases rapidly. This increases the potential for wastage for wine resellers using single bottle system to store and dispense wine; 2. The single bottle system requires that employees of wine resellers manually open, dispense and recork bottles each time a glass of wine is required which is an ineffective use of time and labour at the wine resellers expense; 3. High packaging costs are incurred due to single use packaging increasing costs for both the wine retailer and the environment; 4. High transportation costs are incurred by the wine retailer because of the need to replenish stock of single bottles.

It is not an acceptable alternative to deliver wine in large "bags in a box". It is also not acceptable to have large hidden reservoirs or use kegs in the same manner as beer, which is pumped up from the cellar to a tap on a bar. Wine is an exclusive product that needs to be treated carefully and to be presented properly. The wine purchaser needs to be assured of what is being served.

In a similar way, the dispensing of premium products such as olive oil and quality juices needs to be dispensed in a manner which gives the purchaser confidence of its quality without substantially increasing costs of dispensing.

It is therefore an object of the invention to maintain the benefits of wine storage in bottles and of the purchaser seeing the wine being dispensed from a bottle while overcoming the difficulties and expense of use of small bottles including standard 750 ml wine bottles.

It is also an object of the invention to provide an improved system and apparatus for dispensing liquid, which overcomes or at least ameliorates the problems of the prior art.

SUMMARY OF THE INVENTION

In accordance with the invention there is provided a liquid dispensing device for dispensing a liquid food product including wine, olive oil or fresh juice such as orange juice from a liquid container, the dispensing device having: a base unit having a reservoir, an opening feeding to the reservoir able to receive the outlet of a replaceable liquid receptacle, and a dispensing outlet feeding from the reservoir; a sealing means for substantially sealing the opening of the base unit when the outlet of the liquid container is inserted therein to form a substantially sealed system; and a gas injection system including gas input for supplying a gas to the base unit that limits deterioration or contamination of the liquid food product without harmful effects and which minimizes the difference in gas pressures from within the liquid dispensing device to outside the device when liquid is dispensed from the reservoir.

The liquid container can be a transportable container of the wine, olive oil or fresh juice such as orange juice from the source and is receivable on the base unit to allow dispensing of the wine, olive oil or fresh juice such as orange juice from the liquid container and dispensing device with the liquid container being viewable when in sealing position on the base unit.

The gas injection system can include gas input for supplying a gas to the base unit that limits deterioration or contamination of the liquid food product without harmful effects.

A pressure regulator controls the gas content in the substantially sealed system to maintain substantially the pressure equilibrium after dispensing of a portion of liquid from the reservoir through the dispensing outlet.

The gas is an inert gas relative to the liquid food product such that it does not substantially react with or substantially dissolve into the liquid food product but limits deterioration or contamination of the liquid food product without harmful effects.

The gas can be nitrogen or nitrous oxide or argon. The gas will be an inert gas relative to the liquid food product and lies over the liquid food product without harmful effects.

The sealing means includes the opening of the base unit being shaped to closely correspond with the opening of a uniform replaceable liquid receptacle such as a bottle.

The shaped opening includes a throat substantially complementary to a neck of the uniform replaceable liquid receptacle such as a bottle so that the liquid receptacle is held substantially in position and maintains the substantially sealed system.

The gas input is in one form adjacent the opening of the base unit and is able to substantially smother the liquid food product in the reservoir of the base unit when the replaceable liquid receptacle such as a bottle is being replaced.

Also in accordance with the invention there is provided a liquid dispensing device for dispensing a liquid food product such as wine, olive oil or fresh juice such as orange juice the dispensing device having: a base unit having a case, an internal reservoir, a top opening feeding to the reservoir able to receive the outlet of a replaceable liquid receptacle placed in an inverted position over the opening, and a dispensing outlet external of the case feeding from a lower part of the reservoir; a sealing means including a shaped top opening of the base unit being shaped to include a throat substantially complementary to a neck of the uniform replaceable liquid receptacle such as a bottle so that the liquid receptacle is held substantially in position for substantially sealing the opening of the base unit when the outlet of the liquid container is inserted therein to form a substantially sealed system; and a gas injection system includes gas input for supplying an inert gas relative to the liquid food product such that it does not substantially react with or substantially dissolve into the liquid food product but limits deterioration or contamination of the liquid food product without harmful effects, and a pressure regulator controlling the gas content in the substantially sealed system to maintain substantially the pressure equilibrium after dispensing of a portion of liquid from the reservoir through the dispensing outlet, which minimizes the difference in gas pressures from within the liquid dispensing device to outside the device when liquid is dispensed from the reservoir.

The invention further provides a liquid dispensing system for providing and dispensing wine or other liquid food product by the glass while retaining the remainder of the wine or other liquid food product in substantially sealed condition including the steps of: providing wine or other liquid food product in portable replaceable containers and substantially sealing the replaceable containers airtight; transporting the replaceable containers to the premises of wine or other liquid food product resellers providing wine by the glass; providing each wine or other liquid food product retailer with a liquid dispensing device having a base unit having a reservoir, an opening feeding to the reservoir able to receive the outlet of the replaceable containers, and a dispensing outlet feeding from the reservoir, providing a sealing means for substantially sealing the opening of the base unit when the outlet of the liquid container is inserted therein to form a substantially sealed system; and providing a gas injection system which minimizes the difference in gas pressures from within the liquid dispensing device to outside the device when liquid is dispensed from the reservoir to maintain the system the remainder wine or other liquid food product substantially sealed from the atmosphere preventing spoilage from oxidation.

In addition, each time a portion of wine is dispensed from the dispensing means the dispensed wine can be replaced with inert or non-reactive gas relative to the wine or liquid food product, which maintains a gas cover on the liquid whilst it is in the dispensing means preventing spoilage. Further the liquid dispensing system for providing and dispensing wine or other liquid food product can include the step of as wine is dispensed from the dispensing means it passes through a refrigerated dispensing bowl that modifies the temperature of the dispensed liquid as and if required.

This means of dispensing provides the purchaser with a viewability of the container from which the premium quality liquid is being dispensed. This shows the purchaser that the product is maintained in quality conditions from the time the bulk container was filled to the time the liquid is dispensed from the bulk container in view. This provides confidence in the quality in liquid being sold.

The invention therefore provides a system and method for the transportation, supply, storage, preservation, temperature control and dispensing of wine. The system is beneficial for both wholesale and retail wine distributors and suppliers by enabling the transportation and supply of quality wine in non retail reusable glass bottles, avoiding high packaging costs and package wastage. The system allows for effective dispensing of wine through the attachment of the non-retail glass bottles to dispensing machines providing a quick pouring mechanism preservation and refrigeration. The system ensures that wine supply transportation, packaging and wastage costs are reduced.

The novel features that are considered characteristic of the invention are set forth with particularity in the appended claims. The invention itself, however, both as to its structure and its operation together with the additional object and advantages thereof will best be understood from the following description of the preferred embodiment of the present invention. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

In order that the invention is more readily understood, embodiments thereof will be described which are illustrative of the invention only and not limiting of the invention wherein.

BEST METHOD OF PERFORMING THE INVENTION

Figure 1:
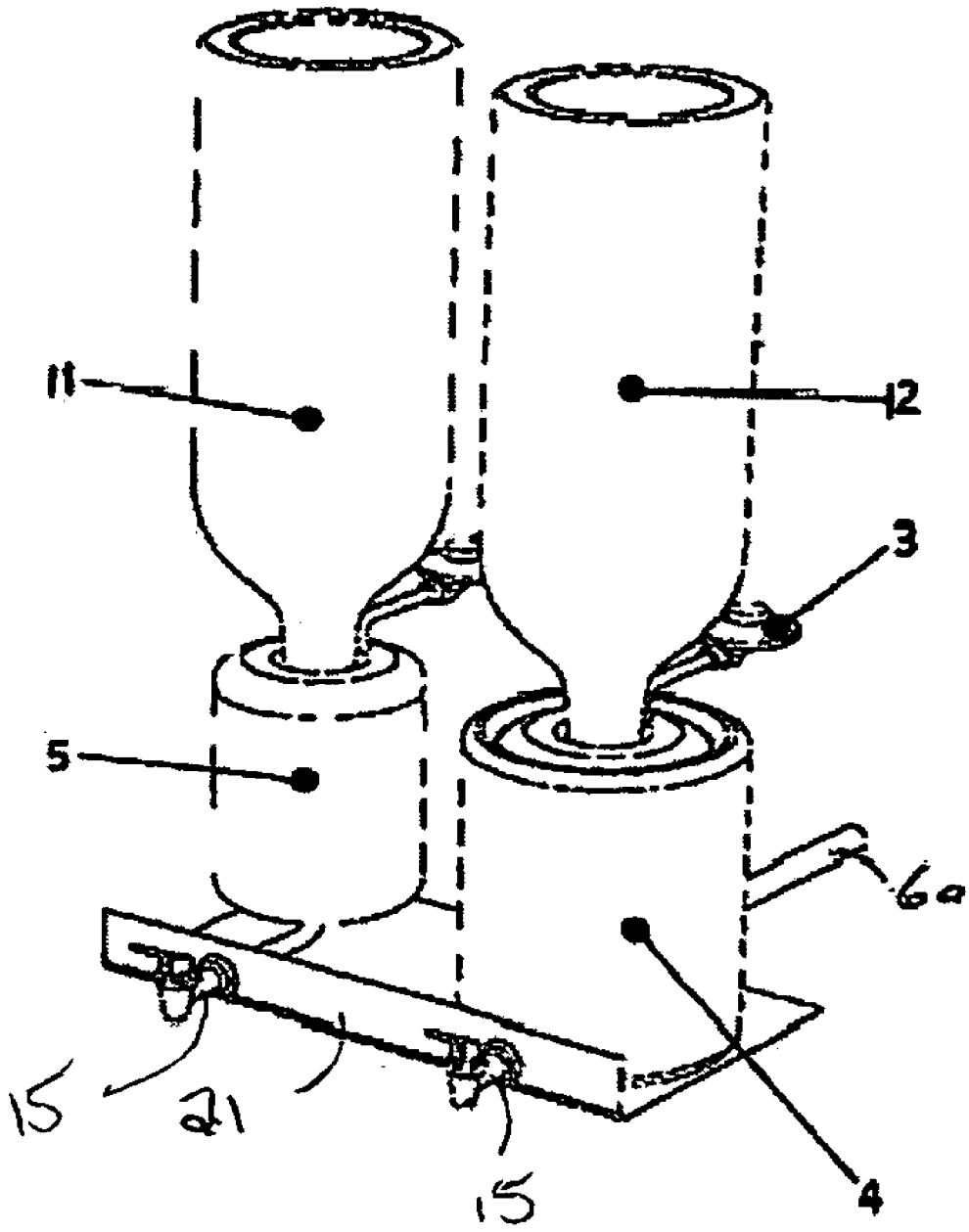
FIG. 1 is a perspective view of a pair of liquid dispensing devices for dispensing a liquid food product including wine, olive oil or fresh juice such as orange juice in accordance with the invention.

Referring to the drawings there is shown a liquid dispensing device in accordance with the invention for dispensing a liquid food product such as wine, olive oil or fresh juice such as orange juice. The dispensing device has two cylindrical base units 4 and 5 having replaceable liquid containers in the form of large long necked bottles 11, 12 inserted in an inverted position into the center of a circular top of the cylindrical base units. Dispensing outlets in the form of outlet pipes 15*a* leading to tap 15*b* extend from lower part of the base units 4 and 5 and are fitted to a mounting tray 21 for decorative and structural purposes.

The base units 4 and 5 are fundamentally the same except that base unit 4 is refrigerated and therefore includes refrigeration parts and outer insulation. Therefore, the non-refrigerated base unit 5 can be for red wine to be served at room temperature while the refrigerated base unit 4 is for chilled white wine. The description will primarily focus on the structure of the refrigerated unit 4.

Figure 2:
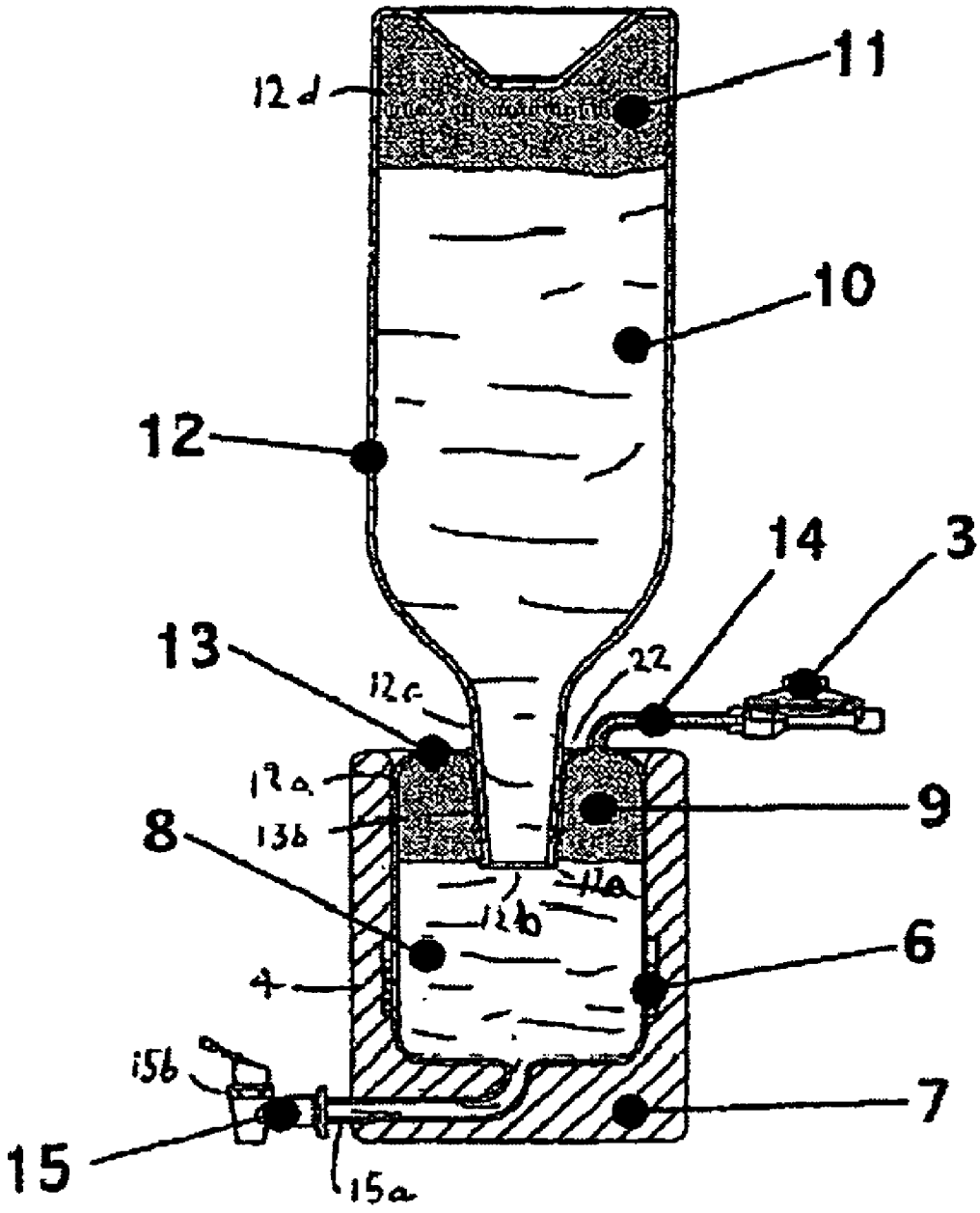
FIG. 2 is a vertical cross section of one of the pair of liquid dispensing devices of FIG. 1.

Referring to FIG. 2 there is shown the base unit 4 having a substantially cylindrical insulation case 7, which is closed at one end, open at the other, and includes an internal reservoir 8 able to hold liquids. A top opening 22 feeds to the reservoir 8 and is able to receive the neck 12*c* and outlet 12*b* of the replaceable liquid receptacle in the form of a bottle 12 placed in an inverted position over the opening 22.

A sealing means in the form of an inner container structure 13 forms a wall of the reservoir 8 and includes a shaped annular top part 13*a*, which makes the opening 22 of the base unit 4. The opening 22 extends into a throat portion 13*b* shaped substantially complementary to the neck 12*c* of the uniform replaceable liquid receptacle being the bottle 12. The bottle 12 is held substantially in position and the opening 22 of the base unit 4 is substantially sealed when the outlet 12*b* of the bottle is inserted therein. A dispensing outlet comprising an outlet pipe 15 leading from the bottom of the reservoir 8 through the insulation case 7 leads to the tap 15*b* external of the case 7.

A gas injection system is used including gas input 14 leading through the top annular part 13*a* of the inner container to the top of the reservoir 8 for supplying an inert gas, relative to the liquid food product, such that it does not substantially react with or substantially dissolve into the liquid food product but limits deterioration or contamination of the liquid food product without harmful effects. A pressure regulator 3 upstream of the gas input 14 controls the gas content in the substantially sealed system to maintain substantially the pressure equilibrium after dispensing of a portion of liquid from the reservoir 8 through the dispensing outlet 15. This minimizes the difference in gas pressures from within the liquid dispensing device to outside the device when liquid is dispensed from the reservoir.

FIG. 2 shows a cross sectional view of the chilled unit 4. The chilled reservoir 8 differs from an unchilled reservoir only to the extent that a means of chilling the liquid stored within the reservoir is provided. In the preferred embodiment of a chilled reservoir shown, a refrigeration circuit featuring an evaporator 6 is wound around the reservoir 8, and is connected to a compressor (not shown) and condenser (not shown) by refrigeration pipe (not shown). Other means of removing heat from the liquid held within the reservoir could be effected, such as pumping a chilled liquid around the reservoir or through a coil immersed in the liquid, or a thermoelectrical device could be implemented to achieve the function of removing heat from the liquid. In the preferred embodiment, insulation 7 is placed around the chilled reservoir 8 to reduce the heat transfer from the surrounds.

The invention also provides a method of dispensing, refrigerating and preservation of perishable liquids. Perishable liquids can be supplied in large bottles 12 adapted to fit the perishable liquid dispenser 4 and 5. The dispensers 4 and 5 are effectively sealed from ambient conditions by the bottle 12 when placed in position as shown in the FIG. 2. In this arrangement, the perishable liquid 10 held in the bottle 12 falls under the gravity into the reservoir 8.

As the perishable liquid 10 falls under gravity, a region of low pressure develops in the inverted top 11 of the bottle 12 dependent on the effect of gravity and liquid pressure.

While the level of liquid 10 within the reservoir 8 lies substantially adjacent the lip 12*a* of the bottle 12, gas 9 is trapped in the upper region of the reservoir 8. This gas 9 can enter the bottle 12 and rise to the top region 11 alleviating the low pressure and permitting more liquid to fall out of the bottle 12 and into the reservoir 8. This continues until the level of liquid within the reservoir again reaches the lip 12*a* of the bottle 12, and stopping further gas from entering the bottle 12 since equilibrium has been reached between the weight of liquid 10 still held within the bottle 12 and the pressure in the upper regions 11 of the bottle 12.

As the perishable liquid is poured from the container, by pulling the tap 15*b*, the level of liquid within the reservoir 8 falls, and gas 9 enters the bottle 12 rising through the liquid 10 to relieve the low-pressure in the upper region 11 and permitting more liquid 10 to enter the reservoir 8. Liquid 10 held within the bottle 12 readily replenish the liquid drawn from the reservoir 8 via the tap 15*b*.

Inert gas, fed under low pressure from gas input 14 after passing a regulator 3 upstream fills the upper regions of 9 of the reservoir 8, preventing ambient air from coming into the liquid stored within the reservoir 8. The pressure of the inert gas entering the reservoir 8 is sufficiently low not to lift the bottle 12 out of the reservoir 8, especially when there is no more liquid 10 left within the bottle 12. The pressure can be regulated to provide only sufficient gas to allow dispensing while dispensing is occurring. The low pressure of the gas is also ideal for permitting the vertical positioning of the tap 15*b* to be lifted above the level of the liquid held within the reservoir 8 the tap can be lifted vertically to a position that will provide easier access for filling a glass.

The reservoir 8 is effectively sealed against the bottle 12 in order to minimize the escape of inert gas into the ambient environment. The sealing may be presented in a variety of manners, and in fact, it may only be necessary to minimize the escape of gases, not eliminate them, as the gas is harmless. In order to minimize the usage of gas it is preferential to prevent inadvertent loss to the atmosphere and a seal is shown in the preferred embodiment of the invention.

Also the system can include a one way return valve (not shown) possibly in the gas input line 14 downstream of the gas regulator 3. If the bottle 12 is subject to heat such as due to air-conditioning being turned off over an extended period or failure then any heating of liquid 10 and expansion therefrom forcing liquid levels to raise in the reservoir 8 and possibly enter the gas input line 14 will not reach the gas regulator 3. Another means of safeguarding this is to include a thermal jacket over the bottle when not in use over extended periods when wine reseller establishment is closed.

Figure 3:
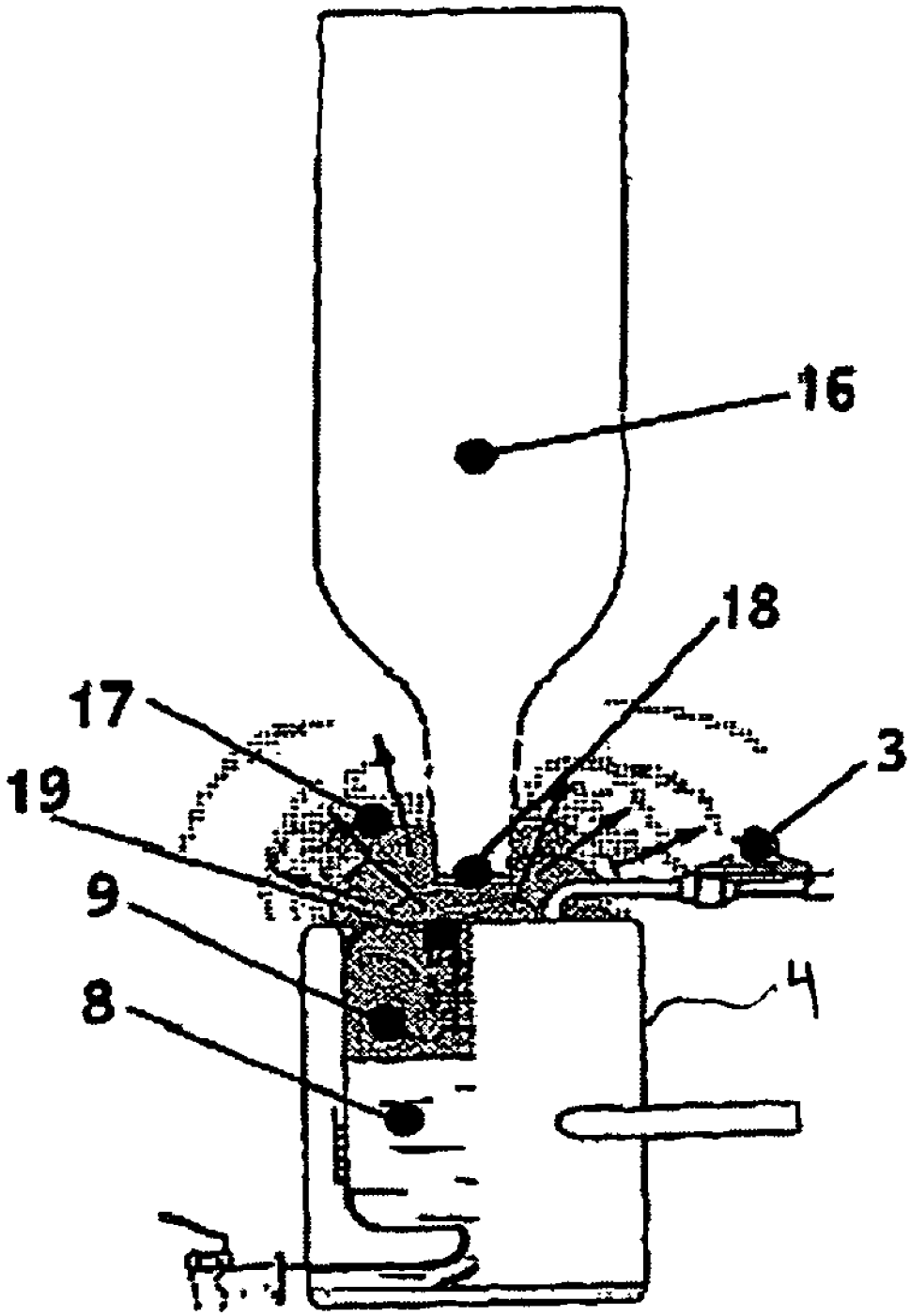
FIG. 3 is a diagrammatic vertical cross section of one of the pair of liquid dispensing devices of FIG. 1 with the replaceable liquid receptacle in the form of a bottle being removed and the action of the gas supply.

With respect to FIG. 3, when a bottle 12 is emptied and needs to be replaced, the bottle is lifted out of the reservoir 8 and a full bottle 16 is lowered back onto the base unit 4. As the empty bottle 12 is lifted from the base unit 4, inert gas escapes from the reservoir 8 via the opening 19 into the ambient atmosphere. The inert gas 17 smothers the top of the reservoir preventing any ambient air entering the reservoir 8. The low pressure at which the inert gas is supplied by the regulator 3 limits the flow of inert gas into the reservoir 8 and limits the rate at which inert gas escapes from the container during the bottle replacement. As a full bottle of liquid 16 is lowered over the reservoir 8, the inert gas 17 escaping from the reservoir 8 smothers the lip of the bottle 18 and purges the entire system. The liquid falling from the bottle 16 into the reservoir 8 remains uncontaminated. When the new bottle 16 is in place the escape of inert gas from the reservoir 8 is limited, if not altogether prevented.

It should be noted that in the embodiment shown here the lip of the bottle 16 is uncovered, liquid could fall from the upturned bottle. In the preferred embodiment, a cap is fitted to the lip of the bottle 18 in order to prevent escape of the liquid. A cap seal can be used that automatically opens when placed in the reservoir 8. In one form the cap seal has a covering portion which covers and seals the lip of the bottle 18, an internal sliding portion which closes the top of the bottle, and an external seal portion for sealing the neck of the bottle in the opening of the reservoir. The reservoir opening includes a central pillar, which pushes the internal sliding portion into the bottle and opens the bottle such that liquid enters the reservoir. As soon as the bottle is lifted off the central pillar the internal sliding portion seals the bottle. Since the bottle must have the liquid material replaced by some material in order to avoid a vacuum, which prevents flow, the bottle is filled by the inert gas. When the bottle is emptied of liquid and removed from the reservoir the bottle is substantially filled with the inert gas. In this way the bottle remains in a readily reusable condition. The container includes a perishable liquid chiller device, which is used to dispense both chilled and unchilled liquid. The liquid chiller consists of reservoirs 4 and 5 as seen in FIG. 1 into which bottles of liquid 12 are inverted such that under the effect of gravity liquid contained within the bottles will enter the reservoirs. It must be noted that in the present embodiment both chilled and unchilled reservoirs are present within the same structure. Other embodiments could separate them into individual reservoirs or multiple combinations thereof.

To prevent contamination of the liquid by ambient air, inert gas is fed into the reservoirs under pressure via the regulator 3 displacing all ambient air within the reservoir and preventing the contamination of the liquid.

The invention further provides a liquid dispensing system for providing and dispensing wine or other liquid food product by the glass while retaining the remainder of the wine or other liquid food product in substantially sealed condition including the steps of providing wine or other liquid food product in portable replaceable containers and substantially sealing the replaceable containers airtight; transporting the replaceable containers to the premises of wine or other liquid food product resellers providing wine by the glass; providing each wine or other liquid food product retailer with a liquid dispensing device having a base unit having a reservoir, an opening feeding to the reservoir able to receive the outlet of the replaceable containers, and a dispensing outlet feeding from the reservoir, providing a sealing means for substantially sealing the opening of the base unit when the outlet of the liquid container is inserted therein to form a substantially sealed system; and providing a gas injection system which minimizes the difference in gas pressures from within the liquid dispensing device to outside the device when liquid is dispensed from the reservoir to maintain the system the remainder wine or other liquid food product substantially sealed from the atmosphere preventing spoilage from oxidation.

Each time a portion of wine is dispensed from the dispensing means the dispensed wine can be replaced with inert or non-reactive gas relative to the wine or liquid food product, which maintains a gas cover on the liquid whilst it is in the dispensing means preventing spoilage. Further the liquid dispensing system for providing and dispensing wine or other liquid food product can include the step of as wine is dispensed from the dispensing means it passes through a refrigerated dispensing bowl that modifies the temperature of the dispensed liquid as and if required.

The invention in use provides a method of transportation, supply, storage, dispensing and preservation of wine and involves the following: 1. Wine is delivered from the winery or other wholesale supplier to a local refilling facility in reusable bulk tanks. Wine is then transferred from the bulk tanks and filled directly into non-retail replaceable containers; 2. The replaceable container is transported in a reusable shipping outer to the premises of wine resellers providing wine by the glass; 3. Each replaceable container is then transferred on to a dispensing means, which holds two non-retail reusable glass bottles for the purpose of dispensing wine as at varied quantities as required; 4. Once the replaceable container is transferred onto the dispensing means spoilage of wine, by oxidation and other contamination, is avoided. Each time a portion of wine is dispensed from the dispensing means the dispensed wine is replaced with inert gas, which maintains a gas cover on the liquid whilst it is in the machine, preventing spoilage; 5. As wine is dispensed from the dispensing means, it passes through a refrigerated dispensing bowl that modifies the temperature of the dispensed liquid as and if required. 6. Once the glass dispensing bottle is empty it is replaced by a full bottle on the dispensing means. The empty glass bottle is replaced in its shipping outer; 7. Periodically the empty glass bottles in their shipping outers are returned to the local refilling facility when a new order is delivered; 8. Glass dispensing bottles returned to the local refilling facility are cleaned and refilled with wine or other perishable beverages that has been delivered from the winery, wine wholesaler or distributor.

A perishable liquid storage, refrigeration, preservation, temperature control and dispensing machine is provided. The invention is beneficial by enabling the transportation, supply of quality perishable liquid in bulk reusable glass bottles, avoiding high packaging costs and package wastage. The invention allows for effective storage, preservation, refrigeration and dispensing of perishable liquid through the attachment of the bulk non-retail glass bottles to dispensing containers providing a quick pouring mechanism, perishable liquid preservation through inert gas injection and refrigeration through a liquid chilling mechanism.

It should be noted that the above description is of a preferred embodiment and variations will be readily understood by a person skilled in the art without any inventiveness and are included within the scope of disclosure of this invention. The invention is therefore not limited to the preferred embodiments but to the following claims defining the essential features of the invention.

The preferred embodiment of the invention is described above in the Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

The invention claimed is:

1. A liquid dispensing device for dispensing a liquid food product including wine, olive oil or fresh juice such as orange juice from a liquid container, the dispensing device having: a base unit having a reservoir, an opening feeding to the reservoir able to receive the outlet of a replaceable liquid receptacle, and a dispensing outlet feeding from the reservoir; a sealing means for substantially sealing the opening of the base unit when the outlet of the liquid container is inserted therein to form a substantially sealed system; and a gas injection system including a gas input into the reservoir for supplying a gas to the base unit that limits deterioration or contamination of the liquid food product without harmful effects and a pressure regulator controller the gas content in the substantially sealed system to maintain substantially a pressure equilibrium which minimizes the difference in gas pressures from within the liquid dispensing device to outside of the device after dispensing of a portion of liquid from the reservoir, wherein the liquid container is a transportable container and is receivable on the base unit to allow dispensing liquid food product from the liquid container and dispensing device with the liquid container being viewable when in sealing position on the base unit.

2. A liquid dispensing device according to claim 1 wherein the gas is an inert gas relative to the liquid food product such that it does not substantially react with or substantially dissolve into the liquid food product but limits deterioration or contamination of the liquid food product without harmful effects.

3. A liquid dispensing device according to claim 2 wherein the gas is nitrogen or nitrous oxide or argon.

4. A liquid dispensing device according to claim 1 wherein the gas is an inert gas relative to the liquid food product and lays over and covers the liquid food product in the reservoir without harmful effects.

5. A liquid dispensing device according to claim 1 wherein the sealing means includes the opening of the base unit being shaped to closely correspond with the opening of a uniform replaceable liquid receptacle such as a bottle.

6. A liquid dispensing device according to claim 5 wherein the shaped opening includes a throat substantially complementary to a neck of the uniform replaceable liquid receptacle such as a bottle so that the liquid receptacle is held substantially in position and maintains the substantially sealed system.

7. A liquid dispensing device according to claim 1 wherein the gas input into the reservoir is adjacent the opening of the base unit and is able to substantially smother the liquid food product in the reservoir of the base unit when the replaceable liquid receptacle such as a bottle is being replaced.

8. A liquid dispensing device for dispensing a liquid food product such as wine, olive oil or fresh juice such as orange juice the dispensing device having: a base unit having a case, an internal reservoir, a top opening feeding to the reservoir able to receive the outlet of a replaceable liquid receptacle placed in an inverted position over the opening, and a dispensing outlet external of the case feeding from a lower part of the reservoir; a sealing means including a shaped top opening of the base unit being shaped to include a throat substantially complementary to a neck of the uniform replaceable liquid receptacle such as a bottle so that the liquid receptacle is held substantially in position for substantially sealing the opening of the base unit when the outlet of the liquid container is inserted therein to form a substantially sealed system; and a gas injection system includes gas input into the reservoir for supplying an inert gas relative to the liquid food product such that it the gas does not substantially react with or substantially dissolve into the liquid food product but limits deterioration or contamination of the liquid food product without harmful effects, and a pressure regulator controlling the gas content in the substantially sealed system to maintain substantially the pressure equilibrium after dispensing of a portion of liquid from the reservoir through the dispensing outlet, which minimizes the difference in gas pressures from within the liquid dispensing device to outside the device when liquid is dispensed from the reservoir.

9. A liquid dispensing device according to claim 8 wherein the gas is nitrogen or nitrous oxide or argon.

10. A liquid dispensing device according to claim 8 wherein the gas is an inert gas relative to the liquid food product and lays over and covers the liquid food product in the reservoir without harmful effects.

11. A liquid dispensing device according to claim 8 including refrigeration means for cooling the liquid food product in the reservoir or just prior to dispensing outlet.

12. A liquid dispensing system for providing and dispensing wine or other liquid food product by the glass while retaining the remainder of the wine or other liquid food product in substantially sealed condition including the steps of: providing wine or other liquid food product in portable replaceable containers and substantially sealing the replaceable containers airtight; transporting the replaceable containers to the premises of wine or other liquid food product resellers providing wine by the glass; providing each wine or other liquid food product retailer with a liquid dispensing device having a base unit with a reservoir, an opening feeding to the reservoir able to receive the outlet of the replaceable containers, and a dispensing outlet feeding from the reservoir, providing a sealing means for substantially sealing the opening of the base unit when the outlet of the liquid container is inserted therein to form a substantially sealed system; and providing a gas injection system into the reservoir which injects inert gas into the sealed system to allow liquid to be dispensed from the reservoir and to maintain the system with the remainder wine or other liquid food product substantially sealed from the atmosphere preventing spoilage.

13. A liquid dispensing system for providing and dispensing wine or other liquid food product according to claim 12 including the step of mounting the replaceable container on the reservoir in such a manner that the container is viewable to the user or customer such that the product remains and can be seen to remain in an uncontaminated form from the bulk supply to the dispensing means by the mechanical and inert gas system.

14. A liquid dispensing system for providing and dispensing wine or other liquid food product according to claim 12 including the step of each time a portion of wine is dispensed from the dispensing means the dispensed wine is replaced with inert or non reactive gas relative to the wine or liquid food product which maintains a gas cover on the liquid in the reservoir whilst it is in the dispensing means preventing spoilage.

15. A liquid dispensing system for providing and dispensing wine or other liquid food product according to claim 12 including the step of as wine is dispensed from the dispensing means it passes through a refrigerated dispensing bowl that modifies the temperature of the dispensed liquid as and if required.

16. A liquid dispensing system for providing and dispensing wine or other liquid food product according to claim 12 including the step of the container having the dispensed liquid replaced by the inert gas and the container having a self seal such that when the container is removed from the reservoir the container is sealed and substantially filled with the inert gas allowing ready reuse of the container.

17. A liquid dispensing device for dispensing a liquid food product, which can deteriorate including wine, olive oil or fresh juice such as orange juice, from a liquid container, the dispensing device having: a base unit having a reservoir, one or more openings at a top portion of the base unit feeding to the reservoir, a sealing means for substantially sealing the one or more openings of the base unit when the outlet of the liquid container is inserted therein to form a substantially sealed system operating at substantially ambient temperature and pressure, each opening able to receive the outlet of a replaceable liquid receptacle with the body of the bottle viewable externally of the base unit when in sealing position on the base unit; a dispensing outlet feeding from the reservoir; a gas injection system including gas input into the reservoir and a pressure regulator controlling the gas content in the substantially sealed system to maintain substantially a pressure equilibrium, the gas injection system supplying an inert gas to the reservoir of the base unit that limits deterioration or contamination of the liquid food product without harmful effects wherein the reservoir of the base unit is able to receive the liquid food product by allowing gradual feed of the liquid from the replaceable liquid receptacles under gravity feed until equilibrium is reached and the gas injection system minimizes the difference in gas pressures from within the liquid dispensing device to outside the device, by allowing replacement of the volume within the liquid dispensing device that has fed to the reservoir and been dispensed through the dispensing outlet, with the inert gas able to bubble from the base unit through the liquid into the head of the liquid dispensing device.

18. A liquid dispensing device according to claim 17 wherein the shaped opening includes a throat substantially complementary to a neck of the uniform replaceable liquid receptacle such as a bottle so that the liquid receptacle is held substantially in position and maintains the substantially sealed system.

19. A liquid dispensing device according to claim 17 wherein the gas injection system is able to inject inert gas over the volume in the reservoir while allowing replacement of the replaceable liquid receptacle which preserves the volume in the reservoir and allows continuous dispensing of liquid food product from the reservoir.

20. A liquid dispensing device according to claim 17, 18 or 19 wherein the base unit includes a replaceable liquid receptacle opening means located near the one or more openings at the top of the base unit to allow opening of the replaceable liquid receptacle when inserted into the opening and automatic closure when removed.

21. A liquid dispensing device according to claim 17, 18 or 19 wherein the gas input provides low pressure gas feed preferably of the order of less an 10 kPa.

22. A liquid dispensing device according to claim 21 including a one way return valve in the gas input downstream of the pressure regulator for protecting the regulator and gas line from backflow.

* * * * *